358-86 SR

OR 4,075,628

1358-86

X340-537

X340-524

United State

Masuda et al.

4,075,628

Feb. 21, 1978

[54] ALARM SYSTEM UTILIZING CABLE-TV MULTI-RECEIVER SYSTEMS

[75] Inventors: Hajime Masuda, Tokyo; Takeshi Takeuchi, Yokohama; Masakatsu Watanabe, Akatsukashin; Yukio Tomioka, Tokyo, all of Japan

[73] Assignee: Hochiki Corporation, Tokyo, Japan

[21] Appl. No.: 742,731

[22] Filed: Nov. 17, 1976

Related U.S. Application Data

[63] Continuation-in-part of Ser. No. 529,148, Dec. 3, 1974, abandoned.

[30] Foreign Application Priority Data

Dec. 29, 1973 Japan ..... 49-4131

[51] Int. Cl.[2] ..... G08B 25/00

[52] U.S. Cl. ..... 340/416; 358/86

[58] Field of Search ..... 340/416; 358/86, 142

[56] References Cited

U.S. PATENT DOCUMENTS

| | | | |
|---|---|---|---|
| 3,105,873 | 10/1963 | Winston et al. | 358/86 |
| 3,244,809 | 4/1966 | Fuller et al. | 358/86 |
| 3,517,120 | 6/1970 | Bunting | 358/86 |
| 3,932,858 | 1/1976 | Smith et al. | 340/416 |

*Primary Examiner*—David L. Trafton

*Attorney, Agent, or Firm*—Frank J. Jordan

[57] ABSTRACT

In a community TV receiving system in which television carrier signals are sent from a common community receiving antenna through a dividing box to respective TV receivers, all connected through coaxial cables, and an alarm system incorporated therein comprising alarm signal generators each having a resistance peculiar thereto connected to the coaxial cables across the core-tube circuit thereof in the vicinity of the respective receivers, and a common alarm receiver operable in response to the peculiar resistances located at a suitable station for indicating the signal generator location without interference to the TV signals.

2 Claims, 14 Drawing Figures

FIG. 13a

| $D_0$ | $D_1$ | $D_2$ | $D_3$ | $D_4$ | $D_5$ | $D_6$ | $D_7$ | $Q_2$ | $Q_1$ | $Q_0$ |
|---|---|---|---|---|---|---|---|---|---|---|
| 0 | 0 | 0 | 0 | 0 | 0 | 0 | 0 | 0 | 0 | 0 |
| 1 | 0 | 0 | 0 | 0 | 0 | 0 | 0 | 0 | 0 | 0 |
| X | 1 | 0 | 0 | 0 | 0 | 0 | 0 | 0 | 0 | 1 |
| X | X | 1 | 0 | 0 | 0 | 0 | 0 | 0 | 1 | 0 |
| X | X | X | 1 | 0 | 0 | 0 | 0 | 0 | 1 | 1 |
| X | X | X | X | 1 | 0 | 0 | 0 | 1 | 0 | 0 |
| X | X | X | X | X | 1 | 0 | 0 | 1 | 0 | 1 |
| X | X | X | X | X | X | 1 | 0 | 1 | 1 | 0 |
| X | X | X | X | X | X | X | 1 | 1 | 1 | 1 |

FIG. 13b

| IN | | | | | | | | | | OUT | | | |
|---|---|---|---|---|---|---|---|---|---|---|---|---|---|
| 0 | 1 | 2 | 3 | 4 | 5 | 6 | 7 | 8 | 9 | 3 | 2 | 1 | 0 |
| 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 | 1 |
| 1 | 1 | 1 | 0 | 0 | 0 | 0 | 0 | 0 | 0 | 0 | 0 | 1 | 0 |
| 1 | 1 | 1 | 1 | 0 | 0 | 0 | 0 | 0 | 0 | 0 | 0 | 1 | 1 |
| 1 | 1 | 1 | 1 | 1 | 0 | 0 | 0 | 0 | 0 | 0 | 1 | 0 | 0 |
| 1 | 1 | 1 | 1 | 1 | 1 | 0 | 0 | 0 | 0 | 0 | 1 | 0 | 1 |
| 1 | 1 | 1 | 1 | 1 | 1 | 1 | 0 | 0 | 0 | 0 | 1 | 1 | 0 |
| 1 | 1 | 1 | 1 | 1 | 1 | 1 | 1 | 0 | 0 | 0 | 1 | 1 | 1 |
| 1 | 1 | 1 | 1 | 1 | 1 | 1 | 1 | 1 | 0 | 1 | 0 | 0 | 0 |
| 1 | 1 | 1 | 1 | 1 | 1 | 1 | 1 | 1 | 1 | 1 | 0 | 0 | 1 |

ALARM SYSTEM UTILIZING CABLE-TV MULTI-RECEIVER SYSTEMS

BACKGROUND OF THE INVENTION

This is a Continuation-In-Part Application of Ser. No. 529,148 filed Dec. 3, 1974, and now abandoned.

This invention relates to an alarm device in which, by utilizing a community receiving system, a signal issued by an alarm signal generator can be received by a common receiving set.

DESCRIPTION OF THE PRIOR ART

An alarm device widely put into practical use in congregated houses etc. at present is provided with electric wiring facilities of its own, and requires considerable expenses for the installation thereof. Besides, it involves many difficulties to perform the installation work in congregated domiciles or houses in which people live. Furthermore, since any trouble of the electric wirings leads often to a fatal disaster in case of emergency, the condition of the electric wirings of such alarm device need be frequently inspected.

SUMMARY OF THE INVENTION

In regions in which the general broadcasting signals are intercepted by high rise buildings, a mountain range or the like, a community receiving antenna is provided, and the signals are sent from the community receiving antenna through cables to respective receivers (for example, television receivers). Taking notice of fact, the present invention has as its object to facilitate the installation of an alarm system in case of providing it in congregated houses having a community receiving apparatus, in such way that electric circuitry of the community receiving apparatus is simultaneously used as electric wirings of the alarm system without separately providing them, and to make it possible to confirm the normelcy of the electric wirings of the alarm system if only the broadcast signals can be received in the respective houses. In this case, it is an indispensable requisite that the signals for broadcast and a signal for alarm do not interfere with each other. This is achieved by employing coaxial cables for the wirings for transmitting the signals.

The signals from the community receiving antenna are sent through a dividing box to a large number of TV receivers. Further, the alarm signal from any one of alarm generators disposed in proximity to the respective TV receivers, is sent through the dividing box to a common alarm signal receiver. Consequently, the alarm signal flows into a dividing circuit if the dividing box and exerts a bad influence on the television signals. Therefore, in order to prevent the alarm signal from branching and flowing to the other output terminals of the dividing box in case where the alarm signal flows via the corresponding output terminal of the dividing box to the common alarm receiver, capacitors are provided between the output terminals and respective choke coils in the dividing box, and therewith, a D.C. passing circuit employing choke coils and permitting only the alarm signal to flow therethrough is separately provided.

Where the alarm signal is issued, the issuing place needs must be found in order to take a countermeasure. Therefore, the respective alarm signal generators are provided with resistances peculiar thereto. The resistance value of the issuing place is detected by the common alarm receiver, and the issuing place is indicated by a position display device.

BRIEF DESCRIPTION OF THE DRAWINGS

FIG. 13*a* shows a truth table at the circuit shown in the FIG. 12, and

FIG. 13b shows output signals supplied from the 4 output terminals corresponding to inputs signals receiving at the 10 input terminals.

DESCRIPTION OF THE PREFERRED EMBODIMENTS

Figure 1:
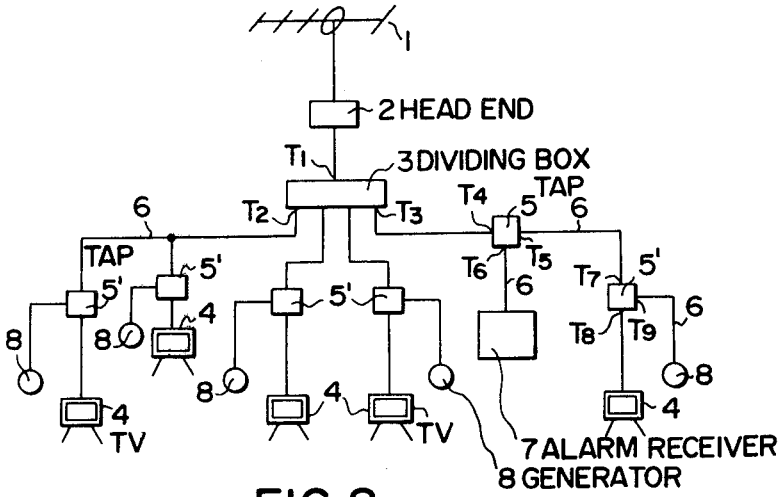
FIG. 1 is a block diagram illustrating the invention.

With reference to FIG. 1 description will be made of an embodiment in which the alarm system of this invention is combined with a community television receiving system. The general broadcasting signals are received by a community master TV signal receiving antenna 1. They are amplified by a terminal circuit in a head end 2, and are fed to a dividing box 3. The antenna, the head end and the dividing or manifold box are connected by coaxial cables having a center core in a shielding tube. The dividing box 3 has a terminal $T_1$ to which the broadcast signals are inputted and a large number of terminals $T_2$, $T_3$ . . . and $T_n$ which deliver the signals. The terminals $T_2$, $T_3$ .. . . and $T_n$ are connected through coaxial cables 6 to input-and-output terminal units 5' which are provided in respective domiciles including apartments and houses. Further, each input-and-output terminal unit 5' is connected through coaxial cables 6 to a television receiver 4 as well as an alarm signal generator 8.

The alarm signal generators 8 are manually or automatically operated as will be stated in detail later. At any position of the coaxial cables 6 between the dividing box 3 and the large number of input-and-output terminal units 5', for example, at a position close to a caretaker's room, an input-and-output terminal unit 5 is provided. The input-and-output terminal unit 5 is connected through a coaxial cable 6 to a common alarm receiver 7, which receives an alarm signal issued by any one of the alarm signal generators 8.

Figure 2:
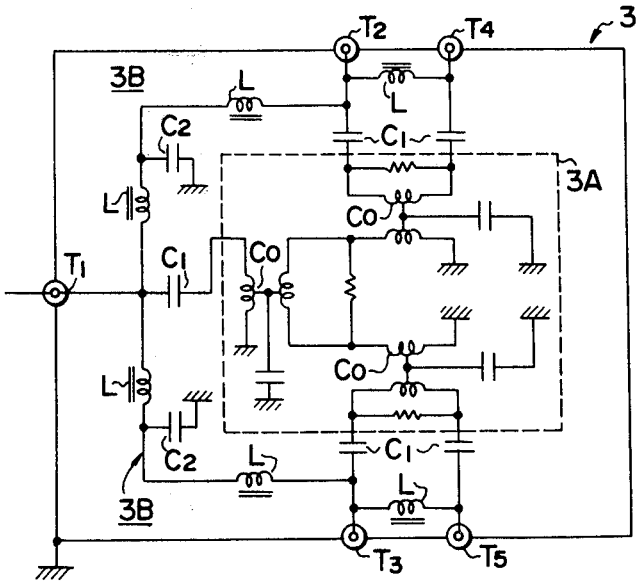
FIG. 2 is a circuit diagram showing an embodiment of a dividing box.

FIG. 2 is a circuit diagram which shows an example of the dividing manifold box 3. A main dividing unit 3A having been already known is formed of an electric circuit in which the number of dividing terminals is increased by successively connecting choke coils *Co* each dividing one input signal into two. An inputting terminal of the dividing circuit is connected through a D.C. blocking capacitor or condenser C1 to the input terminal T1 of the dividing box 3, while the other terminals of the dividing circuit are connected through D.C. blocking condensers C1 to the terminals **T2–T*n* of the dividing box 3, so that the alarm signal may be prevented from branching and flowing into the dividing circuit from the respective terminals T1–T*n***.

Between the terminals **T1–T*n* and the condensers C1 in the dividing box 3, low-pass filters each consisting of choke coils L and a by-pass condenser C2 or only choke coils L are connected, to form a D.C. passing circuit 3B which serves to cause the alarm signal to flow. Accordingly, the television signals enter from the terminal T1 and are divided through the condenser C1 as well as the choke coil Co, and further, they lead to the television receivers 4 in the subscribers' houses or domiciles through the respective condensers C1 as well as terminals T2–T*n*. On the other hand, when any of the alarm signal generators 8 issues the alarm signal, the issued signal passes through the core-tube circuit of the coaxial cables 6 and reaches the common alarm receiver 7 through the terminal unit 5', the dividing box 3 (or without going through the dividing box 3) and the terminal unit 5**. Then, the alarm is indicated.

This operation will be explained in more detail with reference to FIGS. 3 to 5.

Figure 3:
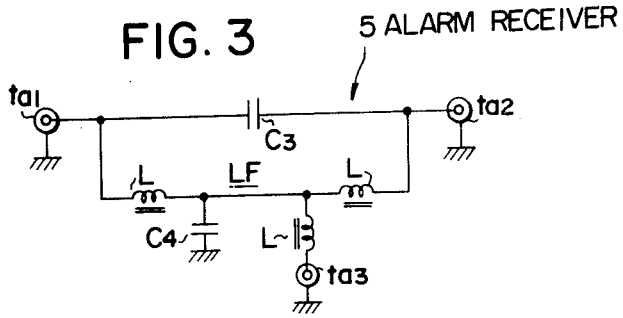
FIG. 3 is a circuit diagram showing an example of an alarm signal receiver terminal unit of the system.

FIG. 3 shows an example of the input-and-output terminal unit 5. A capacitor, or condenser C3 blocking the D.C. alarm signal and passing the television signals, and a low-pass filter LF blocking the television signals and passing the D.C. alarm signal are connected in parallel between input-and-output terminals $t_{a1}$ and $t_{a2}$ to be connected to the coaxial cables 6. The low-pass filter LF consists of two choke coils L and a by-pass condenser $C_4$. An intermediate point between the two choke coils L is connected through another choke coil L to a terminal $t_{a3}$, which is connected to a common alarm signal receiver 7.

Figure 4:
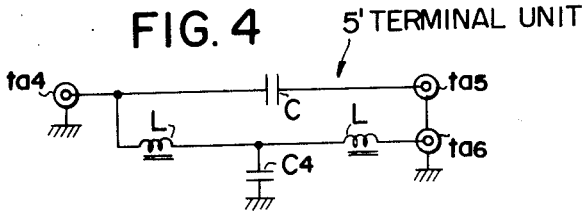
FIG. 4 is a circuit diagram showing an example of a TV receiver terminal unit of the system.

FIG. 4 shows an example of the input-and-output terminal unit 5'. A terminal $t_{a4}$ to be connected with the coaxial cable 6 is connected through a condenser C to a terminal $t_{a5}$ to be connected with the television receiver 4. Further, the terminal $t_{a4}$ is connected through a low-pass filter, consisting of choke coils L and a condenser $C_4$, to a terminal $t_{a6}$ to be connected with the alarm signal generator 8.

Figure 5:
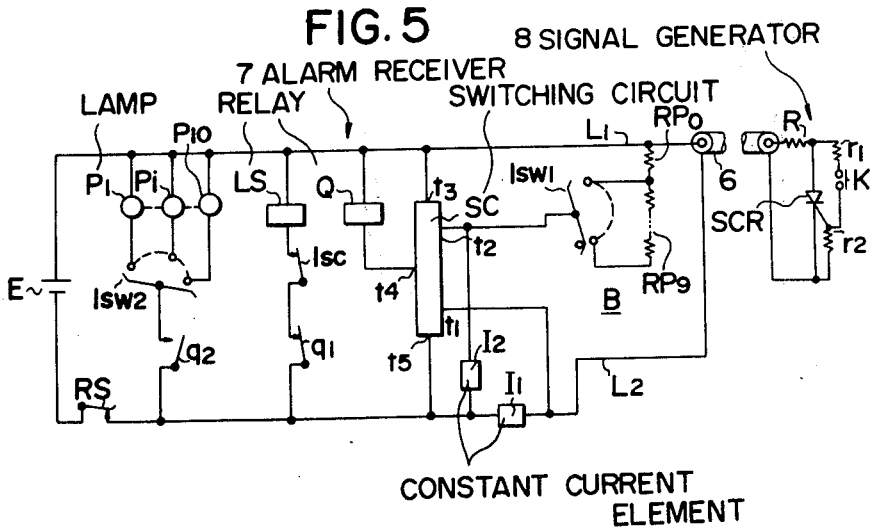
FIG. 5 is a circuit diagram showing an example of an alarm signal generator and a common alarm receiver.

FIG. 5 shows the circuit arrangement of the alarm signal generator 8 and that of the common alarm signal receiver 7. The alarm signal generator 8 on the right in FIG. 5 will be first explained. The core of the coaxial cable, a resistance R peculiar to each alarm signal generator, a thyristor SCR, and the shielding wire or tube are connected in series in the order mentioned. Connected in parallel with the thyristor SCR is a trigger circuit which consists of resistances $r_1$ and $r_2$ and a manual or automatic switch K. When the switch K is turned on, the thyristor SCR is fired to functionally connect the resistance R between the core and the shielding wire of the coaxial cable 6.

The common alarm signal receiver 7 on the left in FIG. 5 will now be explained. A signal line $L_1$ led out from the + pole of a power source E and serving also for power supply is connected to the core of the coaxial cable 6, while a signal line $L_2$ connected to the − pole of the power source E is connected to the shielding wire or tube. A reset switch RS for the power source is incorporated into the signal line $L_2$. A rotary switch $LSW_1$ is provided with fixed contacts of resistance values which correspond to the peculiar resistances of the alarm signal generators 8. A rotary switch $LSW_2$ interlocking with the rotary switch $LSW_1$ is provided with fixed contacts which are connected to respective pilot lamps indicative of alarm issuing places.

Between the signal lines $L_1$ and $L_2$, there are connected in series a relay LS for driving the rotary switches $LSW_1$ and $LSW_2$, a circuit interrupting switch contact *lsc* adapted to be opened and closed by energization and deenergization of the relay LS, and a contact switch $q_1$ of a relay Q adapted to be responsively operated by a switching circuit SC to be described later. The switching circuit SC has a differential amplifier (not shown), whose input terminal $t_1$ is connected onto the anode side of a constant-current element $I_1$ incorporated into the signal line $L_2$, so that a signal representative of the terminal voltage variation of the constant-current element $I_1$ is fed to the switching circuit SC. Another input terminal $t_2$ is connected onto the cathode side of the constant-current element $I_1$ through a constant-current element $I_2$, and is also connected to the base contact of the rotary switch $LSW_1$.

The fixed contacts of the rotary switch $LSW_1$ have resistances with taps $RP_0$–$RP_9$ connected thereto in correspondence with the peculiar resistances of the alarm signal generators 8. One end of these resistances $RP_0$–$RP_9$ is connected to the signal line $L_1$, and the resistances become a variable resistance by turning the rotary switch $LSW_1$ stepwise. Terminals $t_3$ and $t_5$ of the switching circuit SC are respectively connected to the signal lines $L_1$ and $L_2$ as power source terminals. An output terminal $t_4$ of the switching circuit SC is connected through the relay Q to the signal line $L_1$. Upon actuation of the switching circuit SC, the relay Q is functionally connected between the signal line $L_1$ and the signal line $L_2$ through the terminal $t_5$. The relay Q has, besides the above-mentioned contact $q_1$, a contact $q_2$ whose connecting and disconnecting actions are converse to those of the contact $q_1$. The base end of the rotary switch $LSW_2$ is connected through the contact $q_2$ to the signal line $L_2$.

The respective fixed contacts of the rotary switch $LSW_2$ are provided in correspondence with those of the rotary switch $LSW_1$, and they are connected through the respective pilot lamps $P_1$–$P_n$ to the signal line $L_1$.

In U.S. patent application Ser. No. 472,451 filed May 22, 1974, applicant has disclosed an electric circuit for retrieving the signal in the common alarm signal receiving set.

When, in the alarm system thus constructed, the switch K of any one of the alarm signal generators 8 is turned on, the thyristor SCR is fired to functionally connect the peculiar resistance R between the core and the shielding wire of the coaxial cable 6. Accordingly, the peculiar resistance R is coupled to the common alarm receiver 7 (FIG. 5) through the terminals $t_{a6}$ and $t_{a4}$ of the input-and-output terminal unit 5' (FIG. 4) and further through the coaxial cable 6, the dividing box 3 (or without the intervention of the dividing box 3), the coaxial cable 6 and the terminals $t_{a1}$ and $t_{a3}$ of the input-and-output terminal unit 5 (FIG. 3) through which the television broadcast signals flow usually. In this case, the signal corresponding to the peculiar resistance R is inputted at the terminal (T2–T$_n$) to the dividing box 3.

Through the choke coils L, it is delivered from the terminal $T_3$ to the coaxial cable 6. Since the signal cannot pass through the condenser $C_1$, the television broadcast signals are not affected.

As the result of the functional connection between the peculiar resistance of the signal generator 8 and the common alarm signal receiver 7, a circuit along the + pole of the power source E – the signal line $L_1$ – the coaxial cable 6 (core) – the resistance R – the thyristor SCR – the coaxial cable (shielding wire) – the signal line L2 – the constant-current element $I_1$ – the reset switch RS – the – pole of the power source E is established, and it forms a bridge circuit B together with a circuit along the signal line $L_1$ – the resistance (RP0–RP9) – the rotary switch LSW1 – the constant-current element I2 – the signal line L2. The bridge circuit B is a D.C. closed circuit. Since the condenser C precedes the inflow side terminal of each television receiver 4, the bridge circuit B does not influence the television receivers 4.

The output voltages of the bridge circuit B are inputted to the terminals *t*1 and *t*2 of the switching circuit SC in the common alarm receiver 7. When these two input voltages are balanced, the differential amplifier of the switching circuit SC operates to functionally connect the relay Q between the signal lines L1 and L2. When the input voltages are balanced, the differential amplifier operates to functionally disconnect the relay Q. Therefore, when the rotary switch $LSW_1$ is not at the contact position of the resistance (RP0–RP9) corresponding to the peculiar resistance R of the alarm signal generator 8 (unbalance), the switching circuit SC turns on. The relay Q connected to the output terminal *t*4 is energized, so that the contact *q*1 is closed while the contact *q*2 is opened. Upon the closure of the contact *q*1, a current flows through the relay LS owing to a circuit along the + pole of the power source E – the relay LS – the contact *lsc* – the contact *q*1 – the reset switch Rs –the – pole of the power source E, and the relay LS is energized.

When the relay LS is energized, its contact *lsc* is opened. In consequence, the current flowing through the relay LS is interrupted, and the relay LS is deenergized. By one stroke in which the relay LS is energized and deenergized in this manner, the rotary switches $LSW_1$ and $LSW_2$ change-over to the next fixed contacts. After the relay LS is deenergized, the contact *lsc* is closed again. Therefore, until the fixed contact of the rotary switch $LSW_1$ and the peculiar resistance R become corresponding with each other, the switching circuit SC sequentially operates to actuate the relay Q, so that the rotary switches $LSW_1$ and $LSW_2$ move stepwise. When the rotary switches $LSW_1$ and $LSW_2$ move stepwise to reach the predetermined contact (assumed to be the *i*th one), the bridge circuit B holds the relation of $I_1 \cdot RP_i = I_2 \cdot R_i$ and is balanced. Then, the voltages inputted to the input terminals $t_1$ and $t_2$ of the switching circuit SC become zero. The switching circuit SC is consequently turned off, so that the relay Q is deenergized to open the contact $q_1$ and to close the contact $q_2$.

At this time, also the rotary switch $LSW_2$ moves stepwise in unison with the rotary switch $LSW_1$ and reaches the *i*th fixed contact. Accordingly, the pilot lamp $P_i$ corresponding to the issuing alarm signal generator lights up. If a telephone is provided in parallel with the switch K of the alarm signal generator 8 and a telephone capable of communicating a message from the telephone of the alarm signal generator through the coaxial cables thereto is provided in the common alarm receiver 7, a highly reliable alarm will be transmitted.

Since, as described above, the alarm device of this invention uses a community television receiving system and its wiring facilities in common, the installation becomes easy and the arrangement space may be small. Since the alarm issuing place can be known by the provision of the peculiar resistances of the respective alarm signal generators and the display devices operable in response to the peculiar resistances, the countermeasure to follow can be appropriately taken.

Further, since the D.C. passing circuit exclusively for the alarm signal is provided so as to prevent the alarm signal from flowing into the dividing circuit of the dividing box, the television receivers are not adversely influenced by the alarm signal.

In addition, even when the alarm signal is sent through the dividing box to the common alarm signal receiver, it does not flow into the TV signal dividing circuit, and hence, the place for installing the common alarm receiver is not restricted.

Moreover, since circuit is always inspected owing to the reception by the television receivers, a highly reliable alarm system is provided at little cost.

Figure 6:
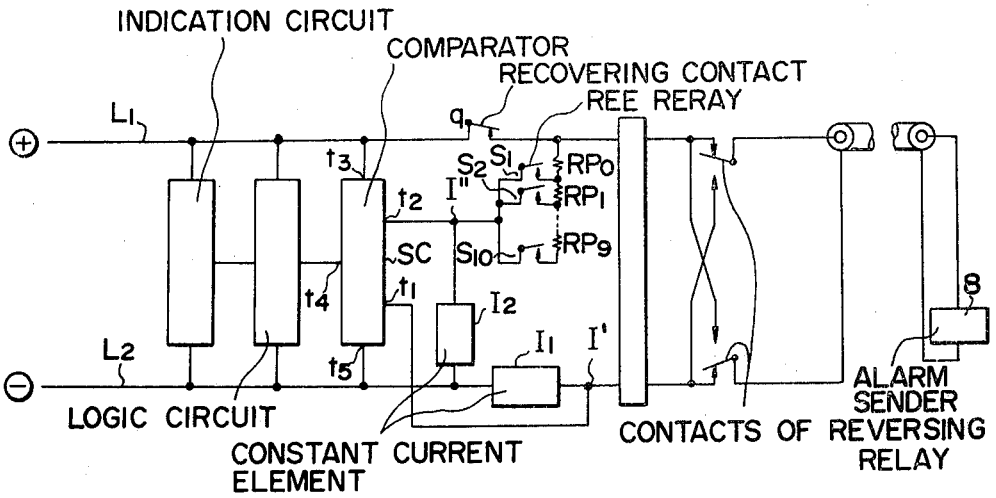
FIG. 6 is a circuit diagram forming a bridge of an alarm sender and another embodiment of a common alarm receiver.
Figure 7:
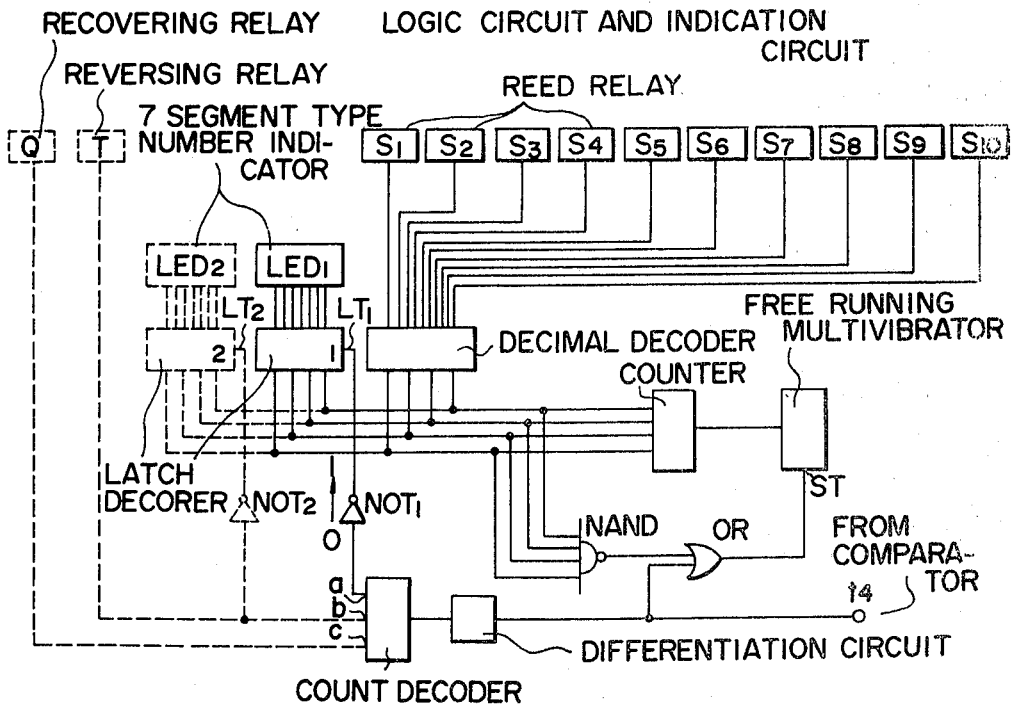
FIG. 7 is the inner circuit of the Logic Circuit and the Indication Circuit used in the FIG. 6.

Referring to the FIGS. 6 and 7, the bridge circuit comprises the alarm receiving circuit 7 having reed relays S1–S10 and the alarm senders 8 having peculiar resistances respectively alloted to each domicile under protection of the alarm system. The bridge sends output thereof by virtue of potential difference between the alarm sender 8 and the alarm receiver 7 to the reed relays of which the standard resistances RPO–RP9 are respectively provided corresponding to the peculiar resistance alloted to each domicile. In this circuit, while the bridge is not balanced the switching or comparator circuit SC sends an output 1 (a high level output) therefrom, but another output 0 (a low level output) may be sent therefrom when the bridge is balanced. The high level output 1 which *os* supplied from the output terminal *t*4 of the comparator circuit SC after an alarm switch K has been pushed at a domicile, inputs at the differentiation circuit and also the terminal ST of Free-Running Multivibrator through the OR gate so as to supply pulses therefrom to the Counter. The interval of pulses is, for example, 8 msec. Binary 4 bits signal is, in this example, sent from the Counter so that the decimal fifteen may be counted. The first output responding to the first count inputs at the Decimal Decoder and actuates the first reed relay S1 so that the first one of the standard resistance RPO is imposed into the bridge circuit. Such a searching action continues till the comparator circuit SC does not output therefrom, that is, a selected one among the standard resistances RP–RP9 will be identified with the peculiar resistance R*x* alloted to the domicile sending the alarm. When no output is supplied from the comparator circuit SC, the differentiation circuit applies its output to the count decoder thereby to shift the output of the latter from the first terminal "*a*" to the second terminal "*b*", so that the NOT1 gate receiving the output of the terminal "*a*" turns to apply its output to the latch terminal LT1 of the latch decoder I to hold the number just appeared at the 7 segments type number indicator LED1 successively fed from the counter. But the counter continues the counting action till it counts the final number predetermined thereat, because the output thereof is also supplying to the input terminal ST of the free-running multivibrator through the NAND gate and the OR gate. Accordingly, when the counter finishes the counting cycle, the output from the NAND gate falls to zero thereby to stop the free-running multivibrator as the output from the comparator circuit has been stopped.

Figure 10:
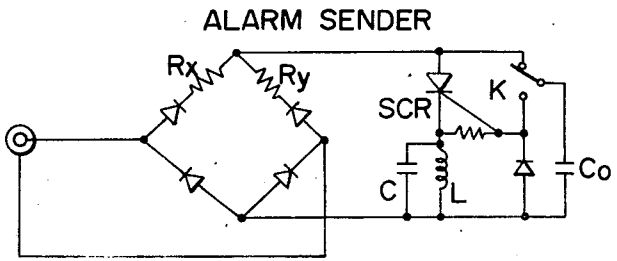
FIG. 10 is also an example of the alarm sender.
Figure 9:
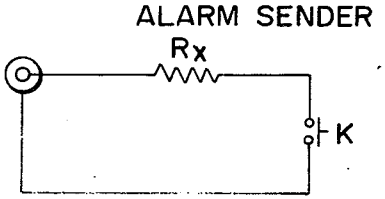
FIG. 9 is another example of the alarm sender.

According to the circuit, a peculiar resistance R*x* of the alarm sender shown at the FIGS. 5 or 9 can be reliably searched and recognized at the alarm receiver. When a pair of peculiar resistances R*x* and R*y* is alloted to each domicile as shown in the FIG. 10, distinguishable number of domiciles may be increased by double even if value of peculiar resistances was not enlarged and also the standard resistances RP0–RP9 was not changed at the alarm receiver. In this alarm sender, resistance R*x* or R*y* is respectively provided at sides adjacent each other of a bridging circuit including one zener diode at each side thereof. The thyristor SCR having L-C circuit at the gate thereof is provided between two tops of opposite positions at the bridging circuit. The remaining two tops are connected between the core and tube of the coaxial cable. A alarm sending switch K and a zener diode in reverse direction to the form are connected in parallel between the anode of the thyristor SCR and the outer end of the L-C circuit, and the gate of the thyristor SCR connects at the junction between the switch K and the zener diode. Further, a capacitor C*o* is connected in parallel to the zener diode so as to contact the one end thereof at the anode of the thyristor SCR or the zener diode by operating the switch K. The sending of the alarm is executed by contacting the switch K with the end of the zener diode thereby to trigger the thyristor SCR since a sufficient electric power is charged at the capacitor C*o*.

Turning to the FIG. 7, the terminal "*b*" of the count decoder is connected at the latch terminal LT2 of another latch decoder through the $NOT_2$ and also is provided with a reversing relay T at the divisional line thereof. And the third terminal "*c*" is provided with a recovering relay Q. Another 7 segments type number indicator LED2 is provided with the secondary latch decoder 11 to which the output of the counter is also supplied. According to this arrangement, the counter continuously operates two counting cycles till the end of the indicating period. Subsequent to the first cycle above mentioned the second counting cycle starts due to the operation of the reversing relay which is accompanied by the shifting of the output from the first terminal "*a*" to the second terminal "*b*" at the count decoder. That is, when the pair of contacts of the reversing relay T changes the direction of flowing the current at the circuit of the alarm sender, the balance made at the bridge circuit comprising the alarm receiver and the alarm sender is broken and the comparator circuit begins again to supply output thereof. So that, the free-running multivibrator is applied by this output and the counter begins its next counting cycle. The reed relays S1–S10 are successively actuating in response to the counting output through the decimal decoder till the end of the second counting cycle.

The number at the counter responding to the reed relay being imposed into the bridge circuit is held at the second number indicator LED2 when the alarm receiving circuit 7 has balanced with the alarm sending circuit 8 due to the correct correspondence of the standard resistance and the peculiar resistance R*y*. At this time, the differentiation circuit supplies its output to the count decoder in response to entrance of no input so that the output of the latter is shifted from the second terminal "*b*" to the third terminal "*c*" and consequently an output is supplied from the $NOT_2$ to the latch terminal $LT_2$ for holding the number entered at the latch decoder 11 at the 7 segments type number indicator LED2.

The recovering relay Q which receives the output from the third terminal "*c*" actuates the contact *q* so as to stop the power supply to the bridge circuit. The alarm sender is recovered to the original state of sending no alarm.

Figure 8:
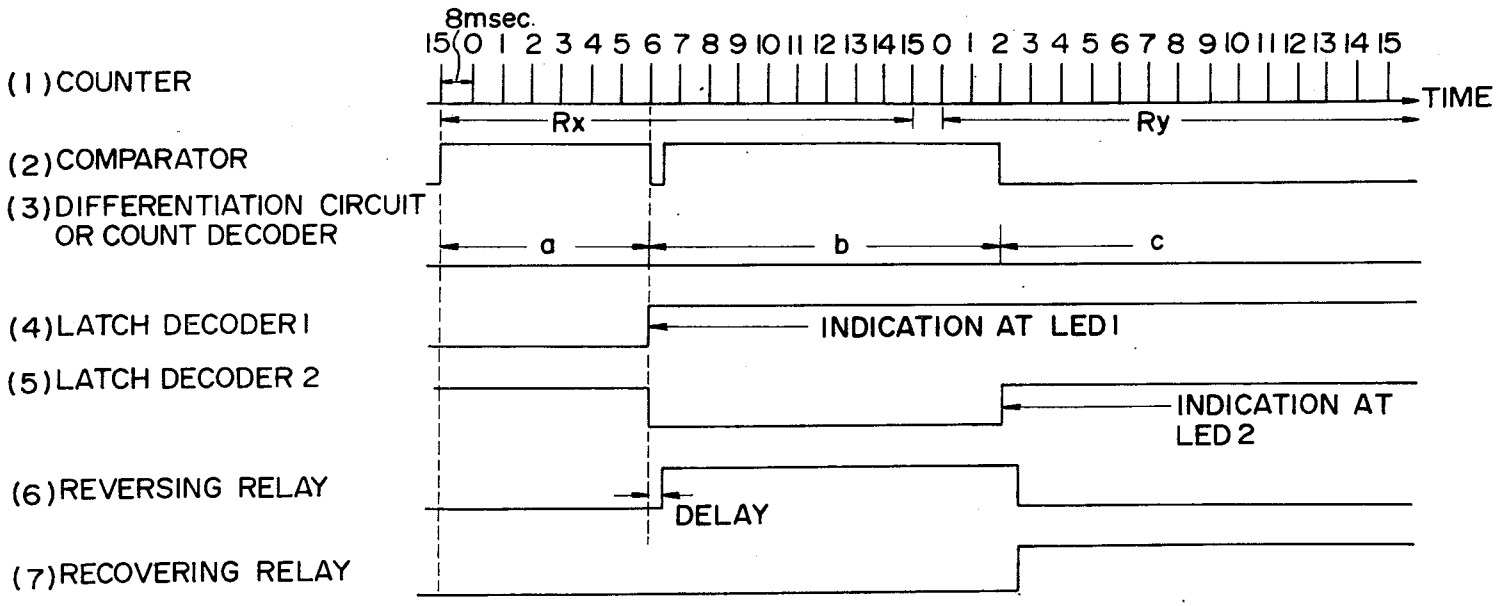
FIG. 8 illustrates the time chart at the circuit of the FIG. 7 including the additional elements shown by broken line.

The time chart of the FIG. 8 illustrates an indicating period comprising two 15 counting cycles. Providing that the R*x* corresponds to the 6th standard resistance RP5; the R*y* to the 2nd standard resistance RP1 of which an aarm sender is used. After an alarm having the two peculiar resistances R*x* and R*y* has been imposed in the bridge circuit, the comparator circuit supplys its output till the counter counts six during which the output of the count decoder flows from the first terminal "*a*". When the voltage falls to zero at the differentiation circuit, the latch decoder 1 holds the number 6 to indicate it at the 7 segments number indicator LED1. And then, the reversing relay is positioned at the actuating state. Consequent to passing of the reversing time, the counter continues its counting action till it counts the final number 15, but advances automatically the next counting cycle till counts the number 2 corresponding to the resistance R*y*, because the bridge circuit is kept in an unbalance state due to the actuation of the reversing relay. During the period of reaching the next balance, the output of the count of the count decoder is flowing from the second terminal "*b*" thereof, so that the other number indicator LED2 does not fix numbers entered from the counter thereat. This indicator fixedly shows two thereat when the imposition of the second standard resistance RP1 results in the balancing at the bridge circuit. By this, the output of the count decoder is shifted from the second terminal "*b*" to the third terminal "*c*", and then, the reversing relay is disenergized; the recovering relay is actuated. According to the time chart, the pair of two numbers which identifies the domicile sending the alarm.

Figure 11:
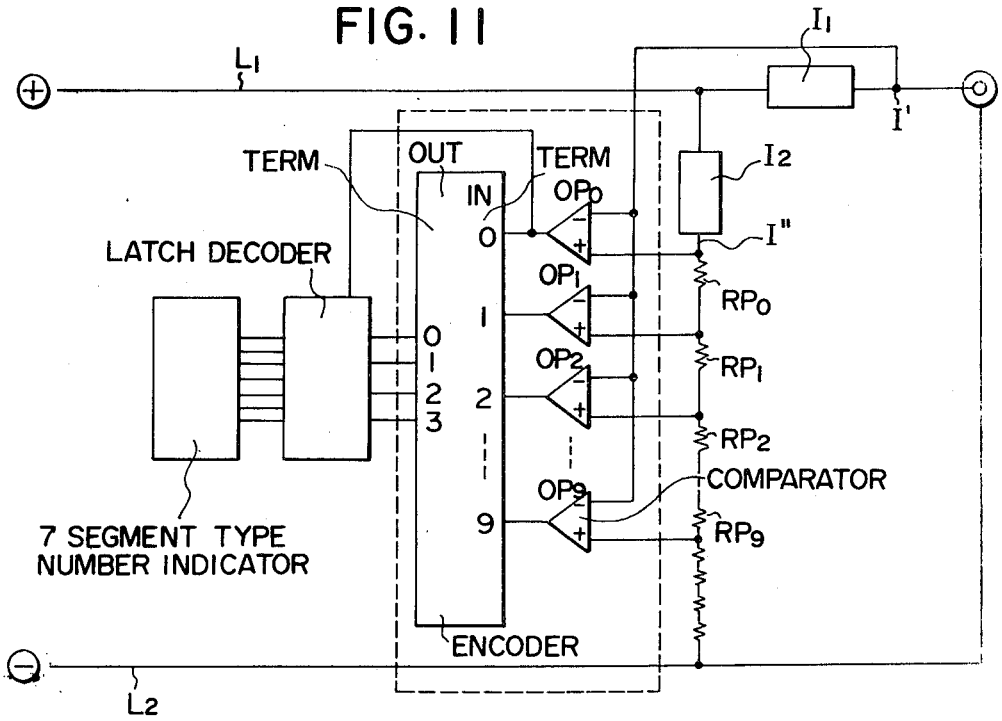
FIG. 11 illustrates partly another embodiment of the common alarm receiver.

Referring to the FIG. 11, the circuit is to use such a comparator circuit as comprises an encoder having 10 input and 4 output terminals and comparators of numbers corresponding to the input terminals. Each standard terminals of the comparators $OP_0$ $OP_9$ connects to the output end I′ of the constant current element $I_1$ which is connected in series to the peculiar resistances alloted respectively alloted to each domicile. To the parallel circuit including another constant current element $I_2$, each measuring terminal of the comparators is connected and the standard resistances $RP_0$–$RP_9$ are respectively imposed in the parallel line between adjacent measuring ends in corresponding in value to that of the peculiar resistance of each domicile. When an alarm sender is operative, the current flows at the bridge circuit through the constant current elements $I_1$ and $I_2$ thereby to produce potential difference between respective standard terminals and measuring terminals due to the resistance values less than the peculiar resistance R*x* being now imposed in the bridge circuit. The arrangement of the stndard resistances RP0–RP9 is in an order of their values. So that, the comparators of which measuring terminals rise at the potential higher than the standard potential will supply to the input terminals 0–9 of the encoder thereby to enter to the latch decoder from the 4 output terminals 0–3 a numerical information corresponding to the peculiar resistance Rx. This information is appeared at the 7 segments number indicator.

Figure 12:
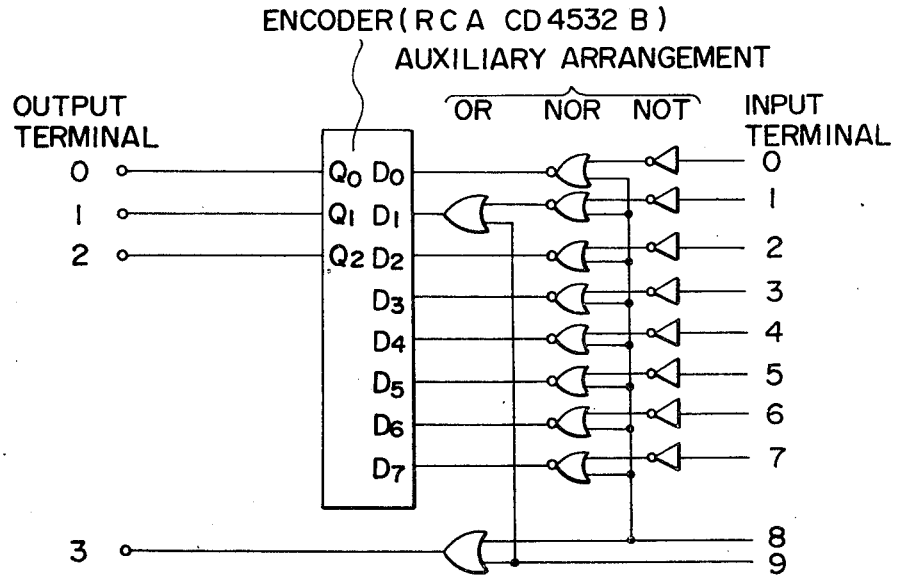
FIG. 12 is a circuit for forming a comparator circuit by using a commercial encoder having 7 inputs and 3 output terminals.

The circuit of encoder shown in the FIG. 12 comprises a commercial encoder having 8 input terminals D0–D7 and 3 output terminals Q0–Q2 and an auxiliary arrangement, so that number of the input terminals increases to 9 terminals 0–9; output terminals to 4 terminals 0–3. For example, RCA CD4532B is available as the commercial encoder. The auxiliary arrangement is shown in the FIG. 12 by using of OR, NOR and NOT elements. According to the truth table shown by the FIG. 13*a*, this RCA encoder can convert 8 inputs to three binary outputs. But, the encoder circuit of the FIG. 12 can convert 10 inputs to four binary output according to another truth table of the FIG. 13*b*, thereby to display any number from zero to nine at the largest number on the 7 segments number indicator.

For example, 10 resistances as Rx are used to have 300 ohms interval therebetween as follows;

| R9 | R8 | R7 | R6 | R5 | R4 | R3 | R2 | R1 | RO | |
|---|---|---|---|---|---|---|---|---|---|---|
| 0.9 | 1.2 | 1.5 | 1.8 | 2.1 | 2.4 | 2.7 | 3.0 | 3.3 | 3.6 | kohms |

In corresponding to such an arrangement, the standard resistances RP0–RP9 use respectively 300 ohms in which the constant current is 4 mA. In this circuit, if 1.8 kohms of R5 is imposed therein, each measuring terminal of the comparators OP0–OP9 has the following potential;

| OP9 | OP8 | OP7 | OP6 | OP5 | OP4 | OP3 | OP2 | OP1 | OPO | |
|---|---|---|---|---|---|---|---|---|---|---|
| 4.8 | 6.0 | 7.2 | 8.4 | 9.6 | 10.8 | 12.0 | 13.2 | 14.4 | 15.6 | V |
| (1.2) | (1.5) | (1.8) | (2.1) | (2.4) | (2.7) | (3.0) | (3.3) | (3.6) | (3.9) | kohms |
| (input resistances) | | | | | | | | | | |

Since the standard voltage is 7.2 V (1.8 kohms × 4 mA) at each comparator, comparators OP0–OP6 of which each measuring terminal receives the voltage higher than the standard voltage 7.2 V can supply its output "1"; the other comparators OP7–OP9 supply output "0". Such outputs can be converted to a coded signals 0 1 1 0 according to the truth table of the FIG. 13*b*. The 7 segments number indicator appears 6 thereon by entering this coded signals.

What is claimed is:

1. An alarm system combined with a cable TV system for a plurality of domiciles, comprising:

a common antenna for receiving broadcast television carrier signals, a coaxial lead-in cable connected to said antenna, a head terminal connected to said lead-in cable having a circuit for amplifying such signals, an amplified-signal coaxial cable connected to said head terminal, a dividing manifold box connected to said amplified-signal cable having a plurality of output signal terminals, an individual-TV receiver coaxial cable having a core and a tube connected to each of said terminals, a separate terminal unit in each domicile connected to each individual-TV receiver cable, and a TV receiver connected to each terminal unit; with an alarm system comprising a DC alarm signal generator associated with each domicile corresponding to each terminal unit, comprising:

a normally open trigger switch-circuit for effectively connecting between the core and tube of a coaxial cable in each terminal unit in each domicile, a resistance of a preselected individual value corresponding to each domicile under protection of the alarm system, in response to need for generating an alarm; and a common alarm receiver located at a convenient station adjacent a terminal unit in one of said domiciles comprising:

a DC alarm signal receiving circuit connected across the core and tube of a coxial cable in the terminal unit adjacent thereto, provided with means for indicating the particular domicile in which an alarm signal is generated by the corresponding alarm signal generator, when the latter switches the corresponding resistance in the core-tube circuit in response to a source of alarm in such domicile, said driving manifold box comprising:

a main TV signal dividing unit circuit in which the number of TV output signal terminals is increased by split choke coil circuits to correspond with the number of domiciles, and an auxiliary circuit including DC blocking capacitors for preventing an alarm signal flowing into said main TV signal dividing circuit, said auxiliary circuit also including low-pass filters comprising choke coils constituting a DC passing circuit for an alarm signal, without interference between the DC alarm and TV signals, each terminal unit comprising:

input and output terminals for TV and DC alarm signals, parallel circuits connecting said input and output terminals one of said parallel circuits containing a capacitor for blocking a DC alarm signal and passing the TV signal, and the other parallel circuit containing a low-pass filter comprising choke coils and a capacitor, for conducting an alarm signal, one of said terminal units adjacent the alarm receiver station also including:

alarm signal receiver terminal in addition to said input and output terminals, and a circuit connecting the tube of the corresponding cable to ground through a choke coil, the other end of the latter circuit being connected to the low-pass filter circuit at a point between the choke coils threof, said alarm signal generator also comprising:

a trigger circuit containing a resistor and an SCR thyristor connected to the core and tube respectively of the cable terminal unit associated threwith, and a firing circuit therefor comprising a normally open switch for energizing said thyristor and inserting said resistor in the core-tube circuit of the cable when said switch is closed, said alarm receiver also comprising:

a + line connected to a source of power and to the coaxial cable core, a − line connected to said power source and to the coaxiable cable tube, a first rotary switch having fixed contacts of resistence which correspond in value to that of the resistances peculiar to the several alarm signal generators, a second rotary switch interlocked with said first rotary switch having fixed contacts, a pilot lamp connected to each of said latter contacts and said + line, for indicating the domicile from which an alarm signal is generated.

a circuit connected across said + and − lines, containing in series a first relay for driving said rotary switches, an interrupting switch adapted to open and close upon energization and deenergization of said relay, and a contact switch of a second relay, and a switching circuit automatically operable in conjunction with said relays and rotary switches for moving the latter stepwise to match the contact of a lamp corresponding to that of the particular domicile source of alarm signal generations.

2. The combination of a cable television receiving system for a plurality of domiciles, comprising:

a common antenna for receiving broadcast television carrier signals, a coaxial lead-in cable connected to said antenna, a head terminal connected to said lead-in cable having a circuit for amplifying such signals, an amplified-signal coaxial cable connected to said head terminal, a dividing manifold box connected to said amplified-signal cable having a plurality of output signal terminals, an individual-TV receiver coaxial cable having a core and a tube connected to each of said terminals, a separate terminal unit in each domicile connected to each individual-TV receiver cable, and a TV receiver connected to each terminal unit; with an alarm system comprising:

a DC alarm signal generator associated with each domicile corresponding to each terminal unit, comprising:

an alarm sender for effectively connecting between the core and tube of a coaxial cable in each terminal unit in each domicile, a resistance of a preselected individual value corresponding to each domicile under protection of the alarm system, in response to need for sending an alarm, and a common alarm receiver located at a convenient station adjacent a terminal unit in one of said domiciles, comprising:

conduction means for looping a D.C. power source and each alarm sender through the core and tube of the coaxial cable, and provided with a first constant current element therein, an auxiliary circuit connected in parallel to said conduction means and provided with a second constant element therein thereby to flow the same current at said auxiliary circuit as the current flows at said conduction means through said first constant current element, said auxiliary circuit including series standard resistances which arrange with orderly value and correspond in value to that of the resistances peculiar to said alarm senders, and output means to send output thereof in response to difference between said standard resistances and said resistances alloted to respective alarm senders said dividing manifold box comprising:

a main TV signal dividing unit circuit in which the number of TV output signal terminals is increased by split choke coil circuits to correspond with the number of domiciles, and an auxiliary circuit including DC blocking capacitors for preventing an alarm signal from flowing into said main TV signal dividing circuit, said auxiliary circuit also including low-pass filters comprising choke coils constituting a DC passing circuit for an alarm signal, without interference between the DC alarm and TV signals.

* * * * *